US011539106B2

(12) United States Patent
Ouchi

(10) Patent No.: US 11,539,106 B2
(45) **Date of Patent: *Dec. 27, 2022**

(54) DIELECTRIC WAVEGUIDE WITH AN ELECTRODE ARRAY CONFIGURED TO PROVIDE A LATERAL VIBRATION OF THE ELECTRIC FIELD IN THE X AND/OR Y DIRECTIONS

(71) Applicant: Kazuyuki Ouchi, Hyogo (JP)

(72) Inventor: Kazuyuki Ouchi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,895

(22) Filed: May 21, 2021

(65) Prior Publication Data

US 2022/0376373 A1 Nov. 24, 2022

(51) Int. Cl.
*H01P 3/16* (2006.01)

(52) U.S. Cl.
CPC ..... *H01P 3/16* (2013.01)

(58) Field of Classification Search
CPC ..... H01P 3/16
USPC ..... 333/239
See application file for complete search history.

(56) References Cited

U.S. PATENT DOCUMENTS 10,446,900 B2 * 10/2019 Ouchi ..... H01P 5/188
2002/0027481 A1 * 3/2002 Fiedziuszko ..... H01P 5/18 333/116

FOREIGN PATENT DOCUMENTS

JP 5732247 B2 6/2015
JP 2017-108394 A 6/2017

* cited by examiner

*Primary Examiner* — Benny T Lee
(74) *Attorney, Agent, or Firm* — IP Business Solutions, LLC

(57) ABSTRACT

A dielectric waveguide device for inputting from the outside and outputting electromagnetic waves of arbitrary frequencies includes the waveguide. The waveguide is provided in which the refractive index of the dielectric material of the waveguide is larger than the outer refractive index, and the propagation speed of electromagnetic waves in the inner region of the waveguide is slower than that in the outer region, the maximum dimensions in the width direction and/or the height direction of the waveguide, the lateral vibration mode curve of the electric field inherent in the waveguide and the electric field attenuation curve outside the waveguide are continuous on both sides of the waveguide in the width direction or the height direction, the electromagnetic waves in the lateral vibration mode of the electric field are transmitted in the form of cosine distribution or sine distribution.

1 Claim, 2 Drawing Sheets

DIELECTRIC WAVEGUIDE WITH AN ELECTRODE ARRAY CONFIGURED TO PROVIDE A LATERAL VIBRATION OF THE ELECTRIC FIELD IN THE X AND/OR Y DIRECTIONS

BACKGROUND OF THE INVENTION

Fields of Invention

The present invention relates to a dielectric waveguide device, and particularly for the waveguide composed of a dielectric material having a refractive index -n- larger than the refractive index outside the waveguide, the electromagnetic waves of arbitrary frequencies in the Hz, KHz, MHz, GHz, THz band and optical band are input into the dielectric waveguide device portion from the outside portion thereof accurately and efficiently with less noise and guided, or outputting electromagnetic waves of arbitrary frequencies in the Hz, KHz, MHz, GHz, and THz bands and optical bands with less noise from the dielectric waveguide device portion.

Description of Related Art

Waveguide technology is an important element in fields such as satellite communication and information communication using microwaves, millimeter waves, or light.

For example, there is proposed the tubular waveguide device in which the input electrode or the output electrode is provided in a tubular waveguide, and the electromagnetic wave is input to the tubular waveguide to guide the electromagnetic wave, or the electric signal is output from the electromagnetic wave propagating in the tubular waveguide, wherein two or more electrodes extending in the width direction of the waveguide are arranged in the direction of electromagnetic wave traveling, and a high-frequency current is applied between the adjacent electrodes of the two or more input electrodes, or an electric signal is output from between adjacent electrodes of one or more output electrodes, and the input electrode or output electrode has an outer peripheral shape of the electrode arrangement embedded in the tubular waveguide, and a specific mathematical formula (By arranging the shape so as to correspond to a part or all of the shape determined by the equation 1) of Patent Document 1, the electronic signal from the outside is input to the tubular waveguide accurately and efficiently and with less noise or the electronic signal of a desired frequency is accurately and efficiently output from an electromagnetic wave guided by the tubular waveguide.

Although the waveguide technology of Patent Document 1 has an excellent effect on the tubular waveguide of electromagnetic waves in the tubular waveguide, it is known whether it is applicable to a solid waveguide of electromagnetic waves in the so-called "dielectric solid waveguide" composed of a dielectric material. Even if it is applicable, the conditions to apply to the dielectric solid waveguide were unknown.

On the other hand, in the dielectric solid waveguide device of Patent Document 2 made of a dielectric material in which the waveguide is made of a dielectric material, when the three directions perpendicular to each other are defined as the X-direction, the Y-direction and the Z-direction, the refractive index -n- of the dielectric material of the waveguide is larger than the outside refractive index in the X direction and/or the Y direction, the present Inventor proposes the dielectric solid waveguide in which the propagation speed of the electromagnetic wave in the Z direction is slower than that of the outer region in the X direction and/or the Y direction, and the maximum dimension of the waveguide in the X direction and/or the Y direction has the dimension specified by the following Formula 1 or Formula 2. When the lateral vibration of the electric field is defined as the vibration of the electric field in the X direction and/or the Y direction and the lateral vibration mode is defined as the vibration distribution of the electric field in the X direction and/or the Y direction, the curve of vibration of the electric field in the X direction and/or the Y direction of the electric field inherent in the waveguide and the electric field attenuation curve outside the waveguide are continuous on both sides of the waveguide in the X and/or Y directions, and the electromagnetic wave in the lateral vibration mode of the electric field is total internal reflected by both sides of the X and/or Y directions of the waveguide and transmitted in the form of a cosine distribution or a sine distribution in the Z direction of the electromagnetic wave, while a plurality of electrodes extending in the X and/or Y directions of the waveguide are arranged at equal intervals in the electromagnetic wave traveling direction Z on the inside or the surface of the waveguide.

$$\tan(k_s a/2)=k_f/k_s \qquad \text{Formula 1:}$$

or $$\tan(k_s a/2)=-k_s/k_f \qquad \text{Formula 2:}$$

Formula 1 is the formula for the cosine (cos) distribution, and Formula 2 is the formula for the sine (sin) distribution. $k_s$: Propagation constant in the low velocity region of the electromagnetic waves, $k_f$: Propagation constant in the high velocity region of electromagnetic waves and a: Width of waveguide.

Regarding the electromagnetic wave waveguide in the optical band, a concept has been proposed in which an optical signal is reflected at a boundary surface in the height direction to propagate an electromagnetic wave in the optical band.

Patent Document 1: Japanese Patent No. 5732247

Patent Document 2: Japanese Patent Application Publication No. 2017-108394

Non-Patent Document 1: A planar dielectric waveguides (Selgio S. Mendoth etc, Department of Physics & Astronomy University of Lousville, Jul. 18, 2010)

SUMMARY OF THE INVENTION

Technical Problem

Although the waveguide technology of Patent Document 2 has an excellent effect on guiding an electromagnetic wave of a specific frequency, it is troublesome because it is necessary to determine the waveguide condition from Formula 1 or Formula 2 each time for any different frequency.

An object of the present Invention is to provide a dielectric waveguide device in which a waveguide composed of a dielectric material having a refractive index -n- larger than the refractive index outside the waveguide, the electromagnetic wave of arbitrary frequencies in the KHz, MHz, GHz, and THz bands and optical bands may be input into the dielectric waveguide device portion from the outside portion thereof accurately and efficiently with less noise and the electromagnetic wave of arbitrary frequencies in the KHz, MHz, GHz, and THz bands and optical bands wave-guided in the waveguide may be output accurately and efficiently with less noise from the dielectric waveguide device portion.

Solution to the Problem

Therefore, the dielectric waveguide device according to the present invention is provided the waveguide in which the refractive index of the dielectric material of the waveguide is larger than the outside refractive index of the waveguide, and the propagation speed of the electromagnetic waves in the inner region of the waveguide is slower than that in the outer region of the waveguide, the maximum dimensions in the width direction and/or the height direction of the waveguide having the dimensions specified by the following Formula 1 or Formula 2, thereby the lateral vibration mode curve of the electric field inherent in the waveguide and the electric field attenuation curve outside the waveguide are continuous on both sides of the waveguide in the width direction or the height direction, wherein the lateral vibration mode is defined as the vibration distribution of the electric field in the width direction or the height direction, the electromagnetic waves in the lateral vibration mode of the electric field are transmitted in the form of cosine distribution or sine distribution, while being totally internal reflected by both sides of the width direction or the height direction of the waveguide, and the waveguide is provided with the electrode array on the inside of the waveguide or the surface thereof in the width direction or the height direction, wherein the electrode array is provided in which the plurality of electrodes extending in the radial direction are arranged at equal intervals with respect to the electromagnetic wave propagation direction, when the wavelength of the electromagnetic wave with respect to the electromagnetic wave propagation velocity outside the waveguide is $\lambda_0$, the dimension a in the width direction or the height direction of the waveguide is determined so as to be constant with respect to $\lambda_0$.

$$\tan(k_s a/2)=k_f/k_s \quad \text{Formula 1:}$$

or $$\tan(k_s a/2)=-k_s/k_f \quad \text{Formula 2:}$$

Formula 1 is the equation when the electromagnetic wave is propagated in the cosine (cos) distribution, and Formula 2 is the equation when the electromagnetic wave is propagated in the sine (sin) distribution. $k_s$: Propagation constant in the electromagnetic wave low velocity region $k_f$: Electromagnetic wave high velocity Region propagation constant a: The maximum dimension of the waveguide in the X and/or Y directions. In the present invention, the term "width direction" may include the height direction.

The mode speed $v_n$ with respect to the width dimension -a- of the waveguide may be obtained, and the nth-order mode shape with respect to the mode speed $v_n$ is determined from Formula 1 or Formula 2. The item related to frequency, that is, the relationship $a/\lambda_0$ can be extracted by Formula 1 or Formula 2. For example, when the frequency increases, the wavelength $\lambda_0$ decreases in accordance with the frequency increasing. If the dimension -a- is determined as the relationship $a/\lambda_0$ have the same value, the mode equations become the same. That is, if the relationship a/AO is constant even if the frequency is changed, the mode equation becomes the same, the obtained $v_n$ has the same value, and the mode shape becomes the same. That is, the solution of the mode equation can be obtained regardless of the frequency of the electromagnetic wave, and the electromagnetic wave induction condition to the dielectric can be obtained for the electromagnetic waves of all frequencies (Hz wave, KHz wave, MHz wave, GHz wave, THz wave and light).

The waveguide of the electromagnetic wave in the dielectric waveguide will be described. When the waveguide is constructed with a dielectric material having a refractive index larger than the refractive index outside the waveguide, the inside of the waveguide is formed in which the electromagnetic wave propagation region in the Z direction (hereinafter referred to as the "electromagnetic wave low velocity region") has a lower velocity than the electromagnetic wave propagation velocity in the Z direction (hereinafter referred to as the "electromagnetic wave high velocity region") outside the width direction X and/or the height direction Y.

The lateral vibration mode of the electric field is specified by the material of the dielectric material and the maximum dimensions of the width direction X and/or the height direction Y of the waveguide such as the lateral vibration mode curve of the electric field inherent in the waveguide and the electric field attenuation curve outside the waveguide are continuous on both sides of the waveguide, and/or on both the upper and lower sides, and the electromagnetic wave determined by the lateral vibration mode of the electric field is totally reflected on both sides of the waveguide and/or both the upper and lower sides, and the electromagnetic wave traveling direction (Z direction) is propagated in the form of cosine distribution or sine distribution in the width direction of the waveguide.

The lateral vibration mode of the electric field is established under the condition that the electric field distribution inside the waveguide and the electric field distribution outside are continuous at the boundary between the inside and the outside of the dielectric waveguide, and the dielectric has a refractive index larger than the refractive index outside the waveguide.

The lateral vibration mode of the electric field inherent in is determined by the material of the dielectric and the width of the dielectric in the lateral width direction X and/or the height in the vertical direction Y.

The lateral vibration mode of these electric fields is represented by a cosine (cos) curve or a sine (sin) curve, and multiple orders exists (mode order n=1 (cosine curve), 2 (sine curve), 3 (cosine curve), 4 (Sine curve) . . . ).

When an electromagnetic wave is guided in the dielectric waveguide, if multiple input electrodes are arranged side by side at intervals according to the wavelength in the direction of electromagnetic wave travel and a high-frequency current is applied between adjacent electrodes, the electromagnetic wave can be accurately and efficiently distributed. Moreover, the electromagnetic wave can be guided with less noise.

That is, when the width and/or height of the dielectric waveguide is set to a size specified by the mode equation shown as Formula 1 or Formula 2, the electromagnetic wave causes the dielectric waveguide to be connected to both boundary surfaces in the waveguide width direction X and/or the height direction Y.

The electromagnetic wave can propagate while being totally reflected at both boundary surfaces in the width direction X and/or the height direction Y of the waveguide, and at that time, a lateral vibration mode of the electric field occurs in the waveguide width direction X and/or the height direction Y.

That is, this mode equation shown by Formula 1 or Formula 2 means that when the width and/or height of the dielectric waveguide is given, the propagation velocity of the electromagnetic wave having the lateral vibration mode can be known.

The lateral vibration mode curve of the electric field inherent in the dielectric waveguide is represented by a cosine curve or a sinusoidal curve. The condition for the existence of the electric field lateral vibration mode of the electromagnetic wave is that the electric field distribution inside and outside the waveguide is continuous at the boundary surface in the width direction and/or the vertical direction of the waveguide.

The mathematical formula in which the lateral vibration mode curve of the electric field and the electric field attenuation curve are continuous at the interface between the inside and outside of the waveguide is Formula 1: $\tan(k_s a/2)=k_f/k_s$ or Formula 2: $\tan(k_s a/2)=-k_s/k_f$. Formula 1 is the equation when the electromagnetic wave propagates in the cosine (cos) distribution, and Formula 2 is the equation when the electromagnetic wave propagates in the sine (sin) distribution. $k_s$: Propagation constant in the low velocity region of electromagnetic waves, $k_f$: Propagation constant in the high velocity region of electromagnetic waves, and a: Maximum dimensions of the waveguide in the X and/or Y directions.

If the continuous condition of the electric field is satisfied on both side surfaces of the dielectric waveguide and/or the end faces of both the upper and lower surfaces, the lateral vibration mode of the electric field of the order corresponding to the material of the waveguide and the width and/or vertical height of the waveguide is established. Reflection is repeated at the end face in the width direction of the waveguide to enter the mode of electromagnetic waves, and the process proceeds in the Z direction. Electromagnetic waves cannot propagate unless the lateral vibration mode is established.

When exciting an electromagnetic wave that has a wavelength in the traveling direction in the waveguide, which is determined by the material of the waveguide dielectric and the width and/or vertical height of the waveguide, the electrode is located at the location of the electric field distribution of the same polarity in the wavelength in the traveling direction in the waveguide. An electric field is generated between the electrodes and coupled with the electric field propagating in the lateral vibration mode. An electric field in the opposite direction to the previous one is generated between the electrodes having the opposite polarity, which is the next polarity of the wavelength in the traveling direction in the waveguide, and is coupled with the electric field propagating in the lateral vibration mode. Therefore, the distance P of the electromagnetic wave traveling direction Z of the plurality of input electrodes needs to be ½ period of the wavelength in the traveling direction in the waveguide. It can be understood that the distance P applies to the output electrode.

Further, the electrode shape does not have to be a cylindrical metal, and may be a thin plate, an elliptical column, a prism, or the like. If the area of the applied electric field is large, the efficiency is determined from the electric field distribution and the electric field mode distribution, but a large amount of electric power can be guided to the electromagnetic wave.

DETAILED DESCRIPTION OF THE PREFERRED EMBODIMENTS

Figure 1:
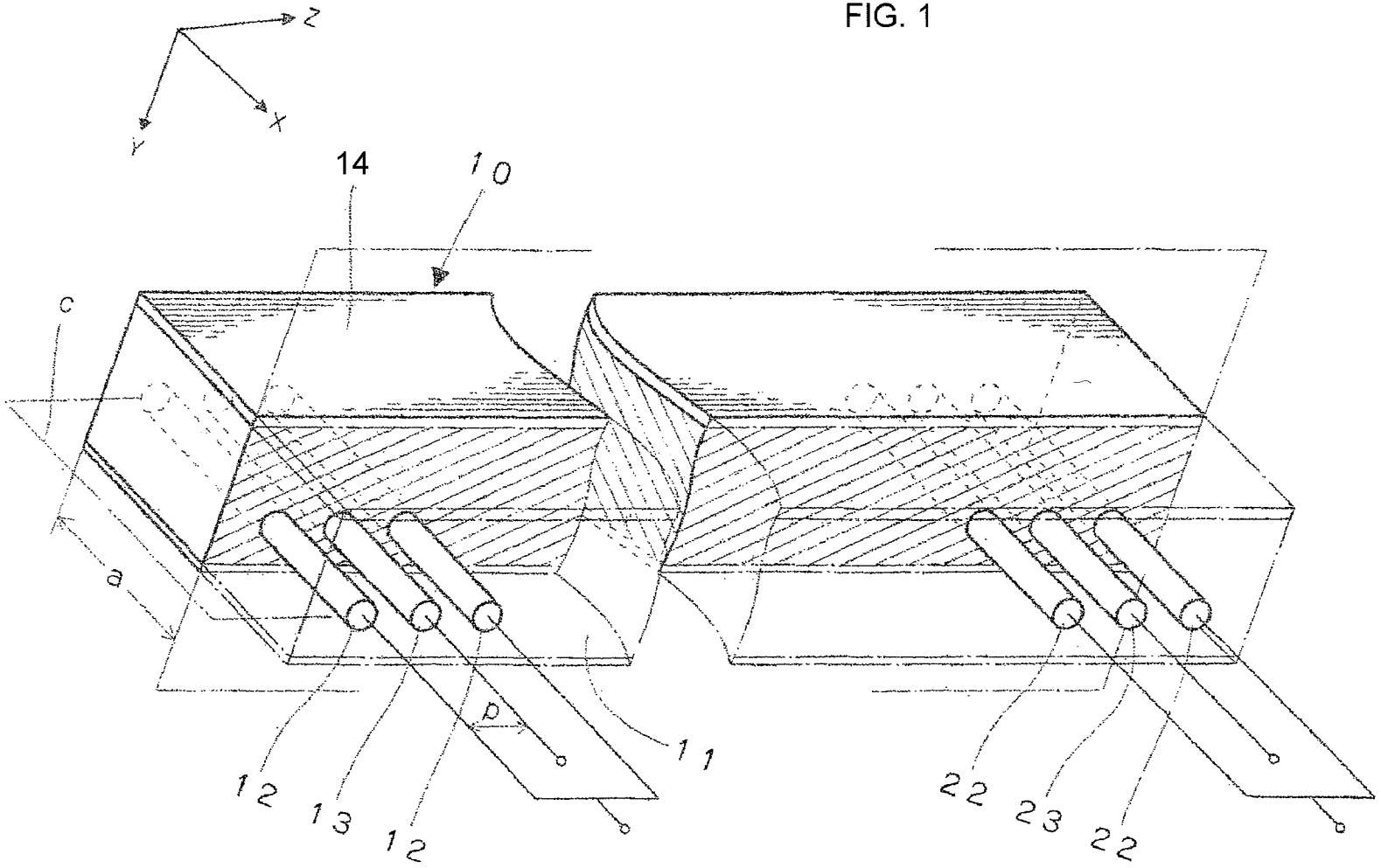
FIG. 1 is a partially cut perspective view showing a preferred embodiment of the dielectric waveguide device according to the present invention.

For example, as shown in FIG. 1, the dielectric waveguide 10 is composed of a dielectric 11 having a refractive index n larger than the refractive index outside the waveguide, and the widthwise dimension of the dielectric waveguide 10 satisfies Formula 1 or Formula 2. Set to dimension -a-, and set the vertical height to less than dimension -a-.

In this case, the upper surface and the lower surface of the dielectric 11 can be sandwiched by a metal body 14 so that electromagnetic waves do not leak from the upper surface and the lower surface of the dielectric 11. Round bar-shaped input electrodes 12 and 13 extending in the width direction X are arranged side by side in the electromagnetic wave traveling direction Z at the center position in the dielectric waveguide 10 in the height direction Y, and are arranged between the adjacent input electrodes 12 and 13.

The opposite electrodes applied a high frequency current are provided. The distance P between the adjacent input electrodes 12 and 13 in the magnetic wave traveling direction is ½ of the wavelength in the waveguide determined by the material constant of the dielectric 11 constituting the dielectric waveguide 10 and the width of the waveguide. Regarding the output electrodes 22 and 23, the distance P between the adjacent output electrodes 22 and 23 in the electromagnetic wave traveling direction is set to ½ period of the wavelength in the waveguide determined by the material constant of the dielectric 11 constituting the dielectric waveguide 10 and the width of the waveguide.

When a high-frequency current is applied between one adjacent input electrode 12 and the other input electrode 13, an electromagnetic wave having a frequency determined by a wavelength of 2P in length can be accurately wave-guided in the waveguide 10.

The input electrodes 12 and 13 are effective at any position in the dielectric waveguide 10 in the height direction Y, but if they are provided near the center c of the height direction Y, they are vertically symmetrical and the operation is stable.

In the case of the output electrodes 22 and 23, as in the case of the input electrodes 12 and 13, the round bar-shaped output electrodes 22 and 23 extending in the width direction X are electromagnetic waves at the center position in the dielectric waveguide 10 in the height direction Y. By arranging the output electrodes 22 and 23 side by side in the traveling direction Z, the transmitted electromagnetic wave signal can be taken out from between the adjacent output electrodes 22 and 23.

It is also possible for the plurality of metal rod in a shape of electrode to be resonance that do not apply voltage in the outer direction (+Z direction, −Z direction) of the electrode to which voltage is applied. The metal rod can be installed on one side or both sides of the electrodes 12 and 13 to which the lead wires are connected in the z-direction or not connected in the z-direction.

Further, the metal rods can be connected each other or cannot be connected each other for providing the performance of resonating electromagnetic waves.

Figure 2A:
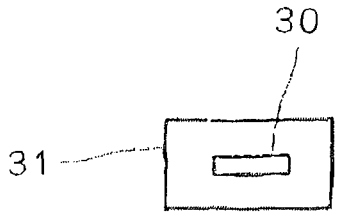
FIG. 2A is the diagram showing the structural example showing the relationship between an electrode and a dielectric.
Figure 2B:
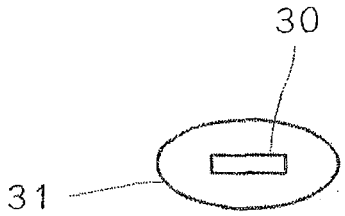
FIG. 2B is the diagram showing the structural example showing the relationship between an electrode and a dielectric.
Figure 2C:
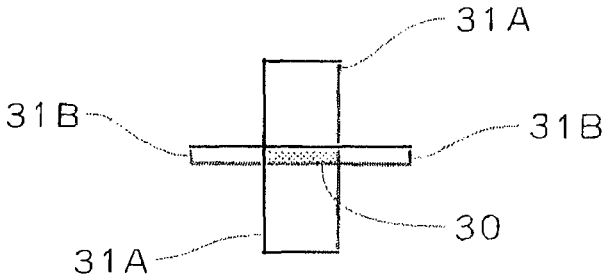
FIG. 2C is the diagram showing the structural example showing the relationship between an electrode and a dielectric.
Figure 2D:
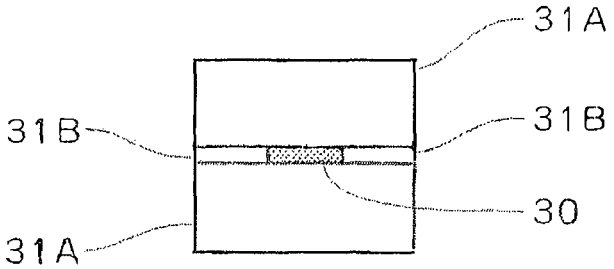
FIG. 2D is the diagram showing the structural example showing the relationship between an electrode and a dielectric.
Figure 2E:
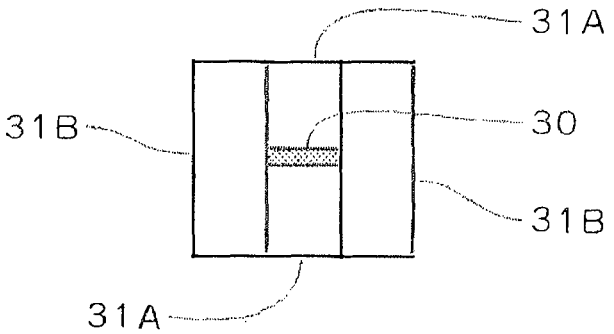
FIG. 2E is the diagram showing the structural example showing the relationship between an electrode and a dielectric.

The dielectric may be a dielectric 31 that surrounds the electrode 30 in a rectangular shape as shown in FIG. 2A, and a dielectric 31 that surrounds the electrode 30 in an elliptical shape or a circular shape as shown in FIG. 2B. Further, as shown in FIGS. 2C, 2D, and 2E, the dielectrics may be dielectrics 31A and 31B having different refractive indexes in the vertical and horizontal directions of the electrode 30.

Dielectric materials include optical glass, magnetic materials such as potassium/tantalum/niobium oxide crystals (KTN), yttrium/iron/garnet crystals (YIG), and known dielectric materials such as zinc oxide, plastics, water, and silicon can be adopted.

Further, the cross-sectional shape of the dielectric material constituting the waveguide can be a rectangular shape or a circular shape (including an elliptical shape). For example, when the dielectric waveguide 10 has a circular cross section, the disc-shaped electrodes 12 and 13 can be adopted as shown in the drawings. In this case, the intermediate portion of the waveguide can be bent according to the laying conditions.

[Example 1] Waveguide Using the Basic Mode with a Frequency of 10 GHz

When the waveguide uses the frequency of the basic mode, the size of the dielectric (optical glass) of the waveguide is set to width a=104.480 mm, thickness (y direction) =3 mm, and copper is used as the electrode material. The cross-sectional shape of the electrode was circular, the overall shape was columnar, the electrode dimensions were 2 mm in diameter, the maximum width was 104.480 mm, the electrode spacing P in the waveguide direction was 10.448 mm, and the total length of the electrodes was 106.480 mm.

[Example 2] Waveguide Using the Basic Mode with a Frequency of 1 THz

When the waveguide uses the frequency of the basic mode, the size of the dielectric (optical glass) of the waveguide is set to width a=1.0448 mm, thickness (y direction) =0.03 mm, and the electrode material is copper. The electrode cross-sectional shape is circular, the overall shape is columnar, the electrode dimensions are 0.02 mm in diameter, 1.0448 mm in maximum width, 0.10448 mm in the electrode spacing in the waveguide direction, and 1.0648 mm in total electrode length.

[Example 3] Waveguide Using the Basic Mode with a Frequency of 10 THz

When the waveguide uses the frequency of the basic mode, the size of the dielectric (optical glass) of the waveguide is set to width a=104.480 um, thickness (y direction) =3 um, and copper is used as the electrode material. The cross-sectional shape of the electrode was circular, the overall shape was columnar, and the electrode dimensions were 2 um in diameter, 104.48 um in maximum width, 10.448 um in the electrode spacing P in the waveguide direction, and 106.48 um in total electrode length.

[Example 4] Waveguide Using the Basic Mode with a Frequency of 100 THz

When the waveguide uses the frequency of the basic mode, the size of the dielectric (optical glass) of the waveguide is set to width a=10.448 um, thickness (y direction) =0.3 um, and the electrode material is copper. The electrode cross-sectional shape is circular, the overall shape is columnar, the electrode dimensions are 0.2 um in diameter, 10.448 um in maximum width, 1.0448 um in the electrode spacing in the waveguide direction, and 10.648 um in total electrode length.

[Example 5] Waveguide Using the Basic Mode with a Frequency of 1 MHz

When the waveguide uses the frequency of the basic mode, the size of the dielectric (optical glass) of the waveguide is set to width a=1044.8 mm, thickness (y direction)=3 mm, and copper is used as the electrode material. The cross-sectional shape of the electrode was circular, the overall shape was columnar, the electrode dimensions were 10 mm in diameter, the maximum width was 1044.8 mm, the electrode spacing P in the waveguide direction was 104.48 mm, and the total length of the electrodes was 1044.81 mm.

[Example 6] Waveguide Using the Basic Mode with a Frequency of 10 MHz

When the waveguide uses the frequency of the basic mode, the size of the dielectric (optical glass) of the waveguide is set to width a=104.48 mm, thickness (y direction)=3 mm, and copper is used as the electrode material. The cross-sectional shape of the electrode was circular, the overall shape was columnar, the electrode dimensions were 10 mm in diameter, the maximum width was 104.48 mm, the electrode spacing P in the waveguide direction was 10.448 mm, and the total length of the electrodes was 104.49 mm.

[Example 7] Waveguide Using the Basic Mode with a Frequency of 100 MHz

When the waveguide uses the frequency of the basic mode, the size of the dielectric (optical glass) of the waveguide is set to width a=10.4480 mm, thickness (y direction) =0.3 mm, and the electrode material is copper. The cross-sectional shape of the electrodes was circular, the overall shape was columnar, the dimensions of the electrodes were 10 mm in diameter, 10.448 mm in maximum width, 1.0448 mm in the electrode spacing in the waveguide direction, and 10.458 mm in total length of the electrodes.

[Example 8] Waveguide Using the Basic Mode with a Frequency of 1 GHz

When the waveguide uses the frequency of the basic mode, the size of the dielectric (optical glass) of the waveguide is set to width a=1.0448 mm, thickness (y direction) =30 mm, and copper is used as the electrode material. The cross-sectional shape of the electrodes was circular, the overall shape was columnar, the dimensions of the electrodes were 10 mm in diameter, 1.0448 mm in maximum width, 0.10448 mm in the electrode spacing P in the waveguide direction, and 1.0548 mm in total length of the electrodes.

[Example 9] Waveguide Using the Basic Mode with a Frequency of 100 GHz

When the waveguide uses the frequency of the basic mode, the size of the dielectric (optical glass) of the waveguide is set to width a=10.448 mm, thickness (y direction) =0.3 mm, and the electrode material is copper. The electrode cross-sectional shape is circular, the overall shape is columnar, the electrode dimensions are 0.2 mm in diameter, 10.448 mm in maximum width, 1.0448 mm is the electrode spacing in the waveguide direction, and 10.648 mm is the total length of the electrodes.

DESCRIPTION OF REFERENCE NUMERALS

10 Waveguide
11 Dielectric
12, 13 Input electrodes
22, 23 Output electrodes

What is claimed is:

1. A dielectric waveguide device for inputting electromagnetic waves of arbitrary frequencies into a dielectric waveguide device portion from an outside portion thereof and outputting the electromagnetic waves of arbitrary frequencies to the outside portion, when three directions perpendicular to each other are defined as a X-direction, a Y-direction, and a Z-direction, the dielectric waveguide device comprising:

a waveguide provided in which a refractive index of a dielectric material of the waveguide is larger than an outside refractive index, and a propagation speed of the electromagnetic waves in an inner region of the waveguide is slower than a propagation speed in the outside portion, maximum dimensions in the X-direction and/or the Y-direction of the waveguide having the dimensions specified by Formula 1 or Formula 2, a lateral vibration mode curve of an electric field inherent in the waveguide and an electric field attenuation curve outside the waveguide are continuous on both sides of the waveguide in the X-direction or the Y-direction, wherein a lateral vibration of the electric field is defined as a vibration of the electric field in the X direction and/or the Y direction and the lateral vibration mode is defined as a vibration distribution of the electric field in the X direction and/or the Y direction, the electromagnetic waves in the lateral vibration mode of the electric field are transmitted in a form of cosine distribution or sine distribution, while being totally internal reflected by both the X direction or the Y-direction of the waveguide, and the waveguide is provided with an electrode array on the inside of the waveguide or a surface thereof in the X-direction or the Y direction, wherein the electrode array is provided with a plurality of electrodes extending in a radial direction arranged at equal intervals with respect to an electromagnetic wave propagation direction, when a wavelength of the electromagnetic wave with respect to the electromagnetic wave propagation speed outside the waveguide is $\lambda_0$, a dimension -a- in the X direction or the Y direction of the waveguide is determined so as to be constant with respect to $\lambda_0$, $$\tan(k_s a/2)=k_f/k_s \quad \text{Formula 1:}$$

or $$\tan(k_s a/2)=-k_s/k_f \quad \text{Formula 2:}$$

Formula 1 is an equation when the electromagnetic wave is propagated in the cosine (cos) distribution, and Formula 2 is an equation when the electromagnetic wave is propagated in the sine (sin) distribution; $k_s$: Propagation constant in the electromagnetic wave low velocity region; $k_f$: Electromagnetic wave high velocity Region propagation constant; a: the maximum dimension of the waveguide in X and/or Y directions.

* * * * *